US008252380B2

(12) United States Patent
Karlsson

(10) Patent No.: US 8,252,380 B2
(45) Date of Patent: Aug. 28, 2012

(54) METHOD AND DEVICE FOR COATING

(75) Inventor: Håkan Karlsson, Säffle (SE)

(73) Assignee: Mattssonforetagen I Uddevalla Akttiebolag, Uddevalla (SE)

( * ) Notice: Subject to any disclaimer, the term of this patent is extended or adjusted under 35 U.S.C. 154(b) by 937 days.

(21) Appl. No.: 12/084,552

(22) PCT Filed: Nov. 28, 2006

(86) PCT No.: PCT/SE2006/050515

§ 371 (c)(1),
(2), (4) Date: Nov. 19, 2008

(87) PCT Pub. No.: WO2007/061378

PCT Pub. Date: May 31, 2007

(65) Prior Publication Data

US 2010/0221438 A1 Sep. 2, 2010

(30) Foreign Application Priority Data

Nov. 28, 2005 (SE) ..... 0502614

(51) Int. Cl.
*B05D 3/12* (2006.01)

(52) U.S. Cl. ..... 427/355; 427/356; 427/428.01; 427/428.14; 118/118; 118/119; 118/126; 118/261; 118/413; 118/414; 118/420; 15/256.5; 15/256.51; 15/256.52; 15/256.53; 162/281; 101/114; 101/120; 101/123; 101/124; 101/169; 101/365

(58) Field of Classification Search ..... 427/355
See application file for complete search history.

(56) References Cited

U.S. PATENT DOCUMENTS

| | | | | |
|---|---|---|---|---|
| 4,247,196 | A | 1/1981 | Ogawa et al. | |
| 5,031,569 | A * | 7/1991 | Eriksson | 118/407 |
| 5,447,747 | A * | 9/1995 | Munter et al. | 427/130 |
| 6,207,021 | B1 | 3/2001 | Eriksson et al. | |
| 6,676,754 | B1 * | 1/2004 | Fleming et al. | 118/325 |

FOREIGN PATENT DOCUMENTS

| | | |
|---|---|---|
| DE | 3931793 A1 | 3/1990 |
| DE | 29621876 U1 | 12/1996 |
| FR | 2 765 813 | 1/1999 |
| GB | 1 289 609 | 9/1972 |

OTHER PUBLICATIONS

Text of the First Office Action issued in corresponding Chinese Patent Application No. 200680044291.8, dated Apr. 13, 2010 (4 pgs).
European Examination Report, European Application No. 06 824 584.4, dated Feb. 25, 2011 (4 pgs).
European Office Action mailed Mar. 23, 2012.

* cited by examiner

*Primary Examiner* — Michael Cleveland
*Assistant Examiner* — James M Mellott
(74) *Attorney, Agent, or Firm* — Jeffrey S. Melcher; Manelli Selter PLLC

(57) ABSTRACT

A method in connection with coating, comprising a running web (8) arranged to be coated with a coating mix (11), coating means (1) arranged in connection with said web (8), a coating surface (6, 7) at the coating means (1) and arranged in contact with said web (8) to dose said coating mix (11), and said coating means (1) being provided with at least a first coating surface (6) and a second coating surface (7), in such a way that it is possible at said running web (8) to switch between the one (6) and the other (7) surfaces while at least one of said surfaces (6, 7) is in an active contact position.

10 Claims, 6 Drawing Sheets

METHOD AND DEVICE FOR COATING

This application is the U.S. National Phase of International Application PCT/SE2006/050515, filed 28 Nov. 2006, which designated the U.S. PCT/SE2008/050515 claims priority to Swedish Application No. 0502614-1, filed 28 Nov. 2005. The entire content of these applications are incorporated herein by reference.

TECHNICAL FIELD

The present invention relates to a coating/dosing means for the application of a coating mix onto a running web, in particular a paper or paperboard web. The invention also relates to a method of coating according to the invention.

PRIOR ART

The so called blade coating technique is a prior art method for the coating of running webs. This technique that exists in lots of varieties is based on the principle that a coating mix is supplied at a surplus to the web at a position prior to the final dosing means.

Said final dosing means are composed of thin flexible blades that, similar to puttying, doses out the final amount of coating mix. The surplus of coating mix from this dosing is returned to the circulation system for the coating mix.

Due to the coating mix containing abrasive particles such as calcium carbonate, titanium dioxide etc. the above mentioned coating blades are subjected to severe abrasion. Hence, abrasion resistance is an important property of the blades. For this reason, there are blades the contact surface of which are coated with especially abrasion resistant materials such as chromium or ceramic materials.

In some cases use of the above mentioned hard blades results in a drawback in quality of the coated layer. By the hard blade having a puttying effect, the applied coating layer will have local variations in thickness, which can be perceived as patchiness in the coating layer. This will affect the ink pick-up in subsequent printing processes, whereby the patchiness will be amplified.

Swedish patent no. 507,926 describes a method in which the flexible blade has a coating of a soft material such as polyurethane. This blade achieves fewer problems in patchiness as well as a prolonged working life for the blade.

Use of said soft blade will however lead to the following major problems: Since the coating mix is supplied at a surplus to the web at a position prior to the final blade dosing, the blade must abut the running web at a time point prior to the application of the coating mix. The polymers that said soft blades are coated with are less temperature resistant than blades of hard materials. Heat results due to the dry friction formed when the blade is brought in contact with the running web, which will destroy the soft coating. In some cases the problem can be overcome by coating the soft part of the blade with a lubricating agent or by supplying a cooling and lubricating agent to the running web during the time between blade contact with the web and the application of the coating mix.

The above mentioned methods have proven to be unreliable, especially in case of high web speeds. If the method of applying a lubricating agent on the blade is used, there is a risk that the agent is consumed before the application of the coating mix, which will lead to blade rejection and a considerable loss of production.

The method of supplying a cooling and lubricating agent to the web has its limitations because of the agent wetting the web which will increase the risk of web break. Since the supply of this liquid to a certain extent overlaps the supply of coating mix, there will also be drying problems for the overlapping period. This leads to depositing problems on drying cylinders and pasting problems in the rolled web.

BRIEF ACCOUNT OF THE INVENTION

The present invention has the object of eliminating or at least minimizing the above mentioned problems by a method according to claim 1 that is characterised in that. a coating means is provided with at least a first coating surface and a second coating surface, in such a way that it is possible at said running web to switch between the one and the other surfaces while at least one of said surfaces is in an active contact position.

Many advantages are attained thanks to a method according to the invention by the provision of a coating means that can be switched between different active contact surfaces while the coating process is in progress. As an example, the invention offers the possibility to start up a coating process with the use of a hard active surface that is durable to the dry friction that occurs before the coating mix is applied but that all the same will result in an acceptable dosing/coating when the coating mix is applied. Then, when it can be made certain that the coating mix covers the running web, switching can take place to a soft active surface with better dosing/coating properties than the heat resistant, hard surface, whereby a very efficient process is achieved that minimizes waste and grounds for disturbances without the need of compromises in terms of quality demand or production speed. Preferably, the device is arranged such that there is maintained an acceptable amount of coating mix during the entire switching period.

Accordingly, a major advantage of a preferred embodiment of the invention is that switching between the active contact surfaces of the coating means, against the running web, can take place during an ongoing coating process without unacceptable amounts of coating mix being supplied to the web during the switching period. The above mentioned feature is preferably achieved by said active contact surfaces overlapping each other during the switching period, i.e. that one active surface is in operation during the switching period to the other active surface.

Switching between different active contact surfaces can also be an advantage in many other connections than the one described above, such as in connection with grade changes.

In the preferred embodiment of the invention the dosing means has two active contact surfaces, but it is within the scope of the invention that several active surfaces can exist for special purposes.

It is within the scope of the invention that the device can be made in many different embodiments. Switching between the active surfaces may for example take place by turning or changing the angle of the coating mean's active surfaces, or by compressive interaction of two individual blades.

DESCRIPTION OF DRAWINGS

In the following, the invention will be described in greater detail with reference to the drawings, of which.

DETAILED DESCRIPTION

Figure 1:
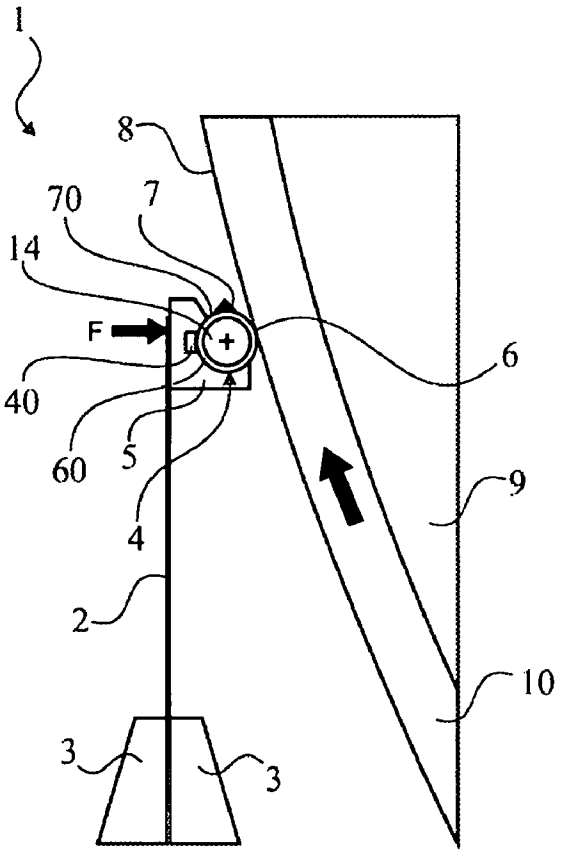
FIG. 1 shows a preferred coating means according to the invention, having a turnable dosing means in contact with a running web prior to the supply of a coating mix.

FIG. 1 shows a schematic view in vertical cross section over a coating means 1 according to the invention. The figure shows the dosing means 1 in contact with the running web 8 that is driven by a roller 9 with a rubber facing 10. In the sequence of operations shown in the figure, the coating means has yet not been supplied, which means that the coating means is exposed to dry friction and thereby high heat. The dosing means 1 has a base part 2 comprising an elongated spring member 2 clamped between two jaws 3. A bearing 5 is fixed at the springy end of the spring member 2, inside which bearing 5 a dosing member 4 is rotatably mounted by a shifting member 40 (such as a toothed wheel in engagement with a toothed track at the dosing member 4); here illustrated only schematically. The dosing member 4 is provided with two coating surfaces 6, 7. One coating surface 6 has the shape of a cylindrical surface 60 arranged at the periphery of the dosing member 4 and the other coating surface 7 is arranged at a longitudinal, triangularly projecting body 70 that is arranged on top of the cylindrical surface 60. One surface 6 is formed from a hard, abrasion resistant material that is tolerable to heat release in connection with dry friction, while the other active surface 7 is formed from a soft material such as polyurethane and intended to be active when it can be determined that there is no dry friction. By the dosing member 4 being rotatably mounted in the bearing 5, it can be chosen in a flexible way, fast and easy, which of the active surfaces 6, 7 that should be in contact with the running web 8. In a manner known per se, a force F is applied via/on the spring member 2, such that a desired pressure is achieved between the dosing member 4 and the running web 8.

Figure 2:
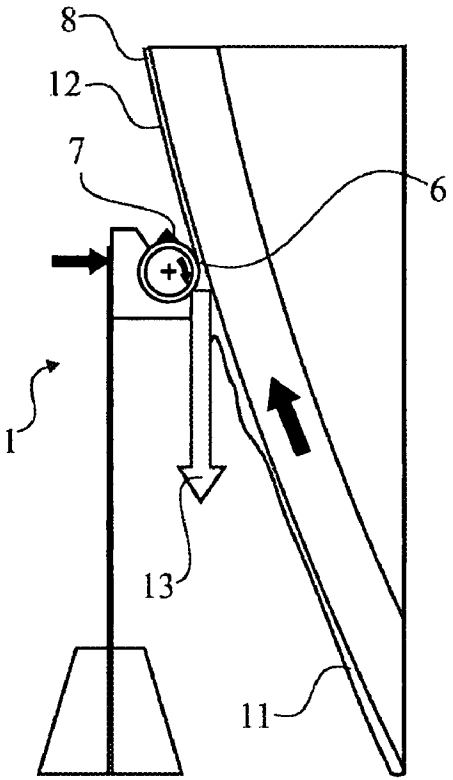
FIG. 2 shows the dosing means of FIG. 1 in a first coating position in which one contact surface is active.

FIG. 2 shows the sequence of the coating operation in which the coating mix 11 has been supplied and in which the coating means 1 operates with the heat resistant contact surface 7 in the active position. This active surface 7 doses the desired amount of coating 12 to the running web 8. The surplus 13 is returned for recirculation (as is known per se).

Figure 3:
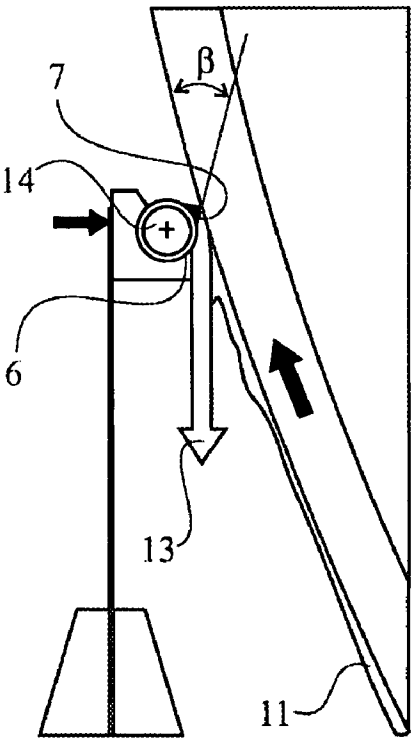
FIG. 3 shows the same dosing means as above, but in a second coating position in which the second contact surface is active.

FIG. 3 shows a situation in which the coating means 1, by (clockwise) turning of the dosing member 4 (by aid of the shifting member 40), has been switched to contact the web 8 by its quality improving but heat sensitive surface 7 that is now being cooled by the coating mix 11. If needed, additional temperature control of the dosing member 4 can take place by arranging a flow of a tempered liquid through the inner support body 14 in the dosing member 4.

Figure 4:
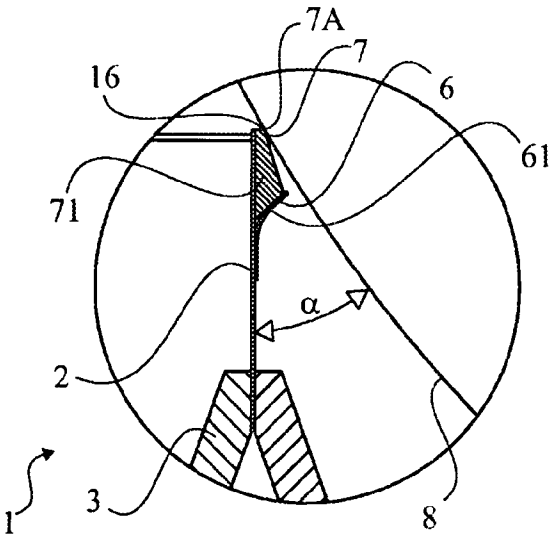
Figure 4:
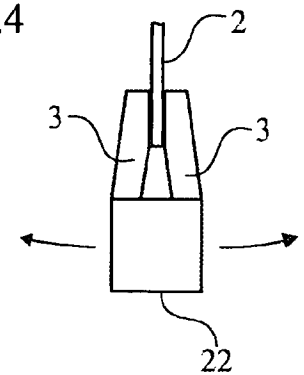

FIG. 4 shows an alternative embodiment of the invention in which the blade 2 is provided with said two contact surfaces 6, 7 in an alternative way. Switching between the two active surfaces 6, 7 takes place by the angle $\alpha$ between the spring member 2 and the web 8 being adjustable such that at a small angle $\alpha$ the hard surface 6 gets in contact and at a larger angle $\alpha$ the soft surface 7 gets in contact. This adjustment of the angle $\alpha$ is preferably achieved by turning of the blade socket about a turning centre 16 at a position that coincides with the outermost active surface 7A of the blade in contact with the running web 8. Similar to the above mentioned embodiment, the blade 2 is clamped in jaws 3 in the blade socket. As is schematically shown in FIG. 4, the jaws 3 are arranged such that a shifting means 22 (such as a hydraulic or pneumatic adjusting means) can move the jaws along a predefined curve, with the purpose of obtaining a desired angle $\alpha$. At the outermost portion of the blade 2 and on one of its sides (that faces the web 8) there is applied an essentially triangularly shaped body 71 that exhibits said soft active surface 7. The hard active surface 6 is arranged at a separate detail 61 that is bent in the vertical plane and fixed at the blade 2 by its lowermost part below the triangular body 71 and that by its upper part extends up above and somewhat past (or at least flush with) the extension (i.e. the plane) of the active soft surface 7. Hereby, an outer edge 6A is created that extends somewhat outside the plane of the active soft surface 7. The figure shows a position in which the tip 7A of the soft surface 7 is active and in contact with the running web 8, which accordingly takes place when it has been made sure that there is coating mix (not shown) on the web 8.

Figure 5:
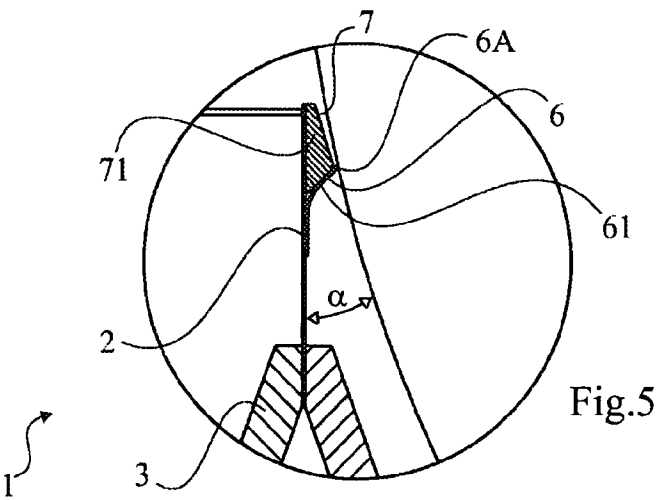

FIG. 5 shows the situation after adjusting the angle of the blade socket, e.g. by turning the blade socket about the turning point 16 such that the angle $\alpha$ is decreased, whereby instead the hard surface 6 of the blade becomes active, which is done e.g. in connection with start up and shutting down.

Figure 6:
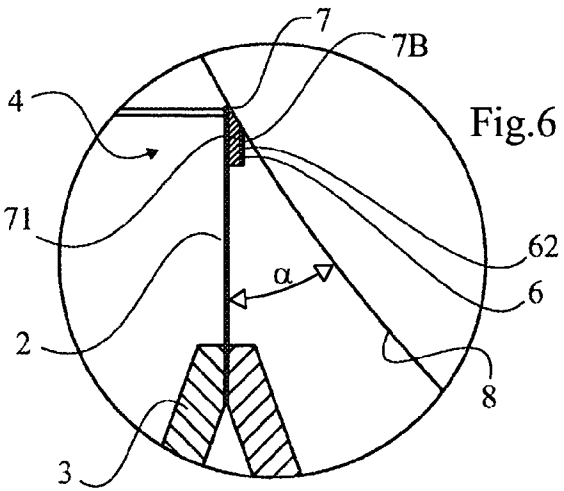
FIG. 4-6 show an alternative embodiment of the invention where switching between two active blades takes place by turning the blade socket.

FIG. 6 shows an alternative way of attaching the hard surface 6, in which said surface 6 is arranged at a flat, elongated, hard part 62 that is joined with the softer body 71 only at a lower portion 7B thereof. The upper part of the soft body 71, above the blade 62, is triangularly shaped by being narrowing towards the end of the spring blade 2. In this embodiment there is accordingly no need for an attachment of the blade 62 on the spring blade 2 itself. The operating principles of this embodiment are exactly the same as in respect of FIGS. 4 and 5, i.e. by choice of the angle $\alpha$ either the hard surface 6 or the soft surface 7 will be in active contact with the web 8.

Figure 7:
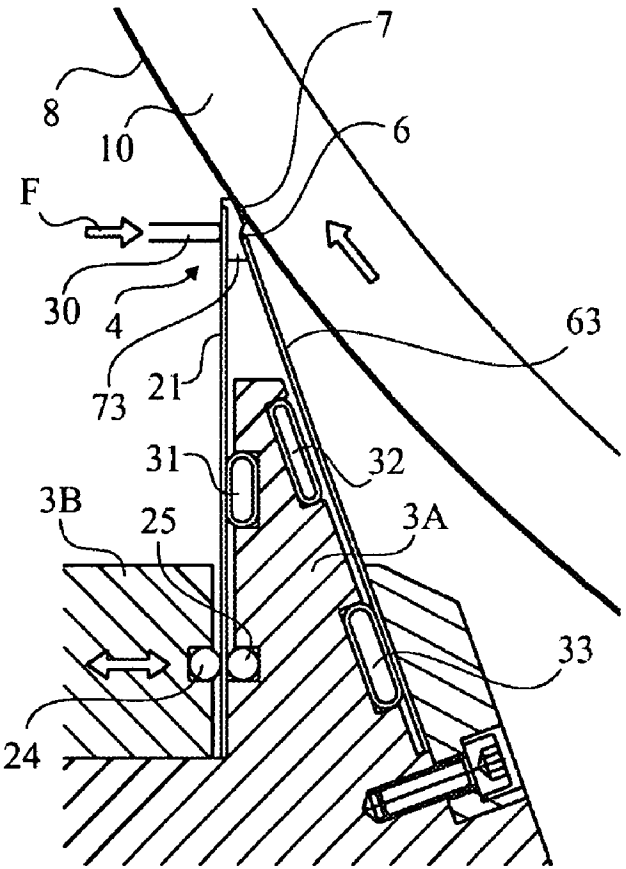

FIG. 7 shows an embodiment in which switching between the contact surfaces 6, 7 takes place by compressive interaction between two separate blades 21, 63. The outermost blade 21 is tiltably clamped between a fixed jaw 3A and a moveable jaw 3B. The ability to tilt is achieved for example by clamping the blade between a hard round stave 24 and a soft round section 25. The outermost blade 21, that at its end carries a soft body 73 with the soft contact surface 7, is by a certain force and by aid of a pressing list 30 (that is known per se and that is therefore not shown in detail) pressed against the running web 8 and the counter pressure roll 10, whereby a desired force F can be applied on the web 8 via the soft surface 7. The outermost blade 21 can be moved out from the web 8 by expansion of a pressure hose 31 that is arranged between the blade 21 and the fixed jaw 3A at a position above the tilting point 24, 25 of the blade.

The innermost blade 63 that is provided with the hard surface 6 at its end, is only attached to the fixed jaw 3A.

Pressure hoses 31, 32, 33 are positioned in recesses in the fixed jaw 3A. Two 31, 32 of these have the object of affecting the movement of the blades 21 and 63, respectively. The object of the third pressure hose 33 is to retain the innermost blade 63. The second hose 32 acts on the upper part of the inner blade 63 and its object is to press the hard surface 6 of the blade 63 (at the tip of the blade 63) against the running web 8. FIG. 7 shows a situation in which the surface 7 of the outermost blade 21 is active. Here, all pressure hoses 31, 32 are in a non expanded mode, i.e. are inactive, whereby it is achieved that the soft surface 7 of the outer blade 21 is pressed by the pressing force of the pressing list 30 against the web 8. The inner blade 63 is in a non active position and by its inner blade springing it has sprung away from the web 8, such that a distance is formed between its contact surface 6 and the web 8. The upper portion of the blade 63 will then rest on a lower portion 7C of the soft body 73. This function can be achieved by the inner blade 63 being arranged such that its tip 6A is positioned at a lower level than the tip 7A of the soft body 73. In other words, the outer blade 21 extends further up on the web 8 periphery than the inner blade 63 does, such that the tip 7A of the outer blade is at a position beyond the tip 6A of the inner blade as seen in the running direction of the web.

Figure 8:
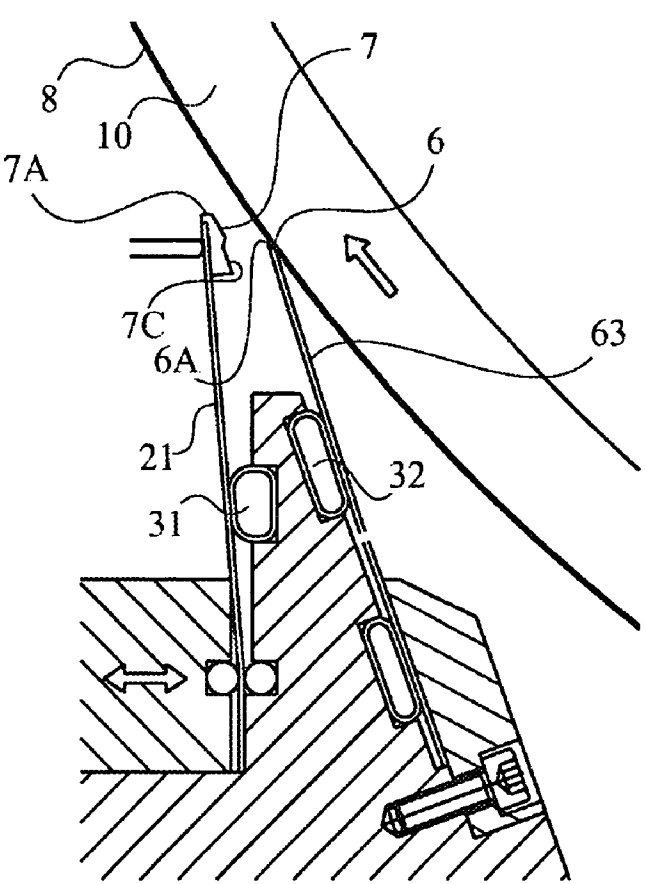
FIGS. 7 and 8 show yet another embodiment of the invention, where switching of contact surfaces takes place by compressive interaction of two individual blades.

FIG. 8 shows a situation according to the principle mentioned above, in which switching has taken place such that the tip 6 of the inner blade 63 is active. This is achieved by activation of the first pressure hose 31 and the second pressure hose 32 such that they expand. Thereby, the second pressure hose 31 will affect the outermost blade 21 to flex out from the web 8, and the inner pressure hose 32 will affect the inner blade 63 to flex in towards the web 8.

In the above exemplified embodiments a field of use is described in which two different materials are used in the active surfaces 6, 7 of the dosing means 4 in order to achieve a quality improving effect by, in operating mode, being able to use an active surface 7 that does not endure the heat formed by dry friction in connection with starting up and shutting down of the coating operation. It is realised however that the invention can be used also in other fields of use or situations, one of which is described below.

Figure 10:
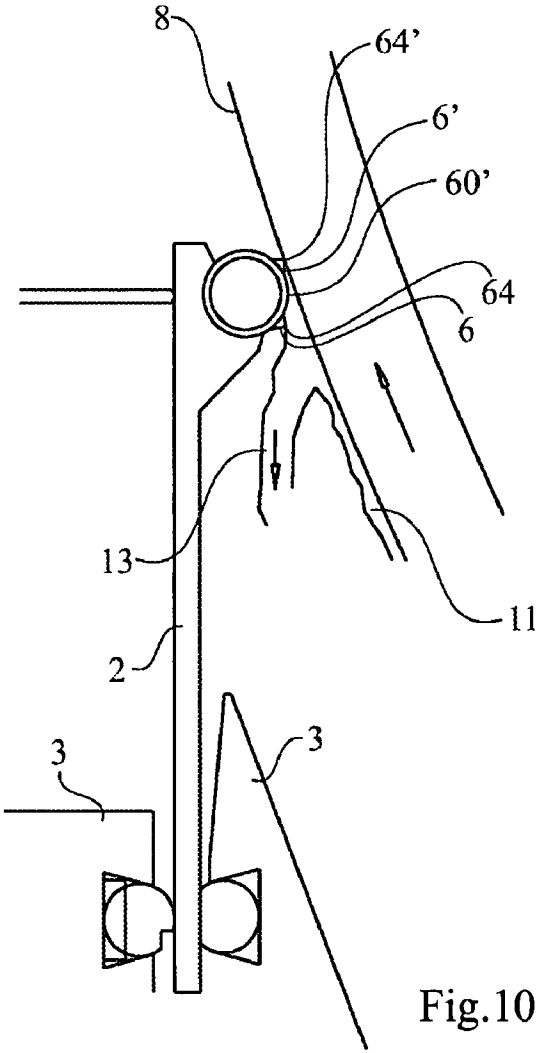
FIGS. 9 and 10 show yet another embodiment of the invention, with basic principles similar to the ones in FIGS. 1-3, FIGS. 11 and 12 show yet another modification of the invention.
Figure 9:
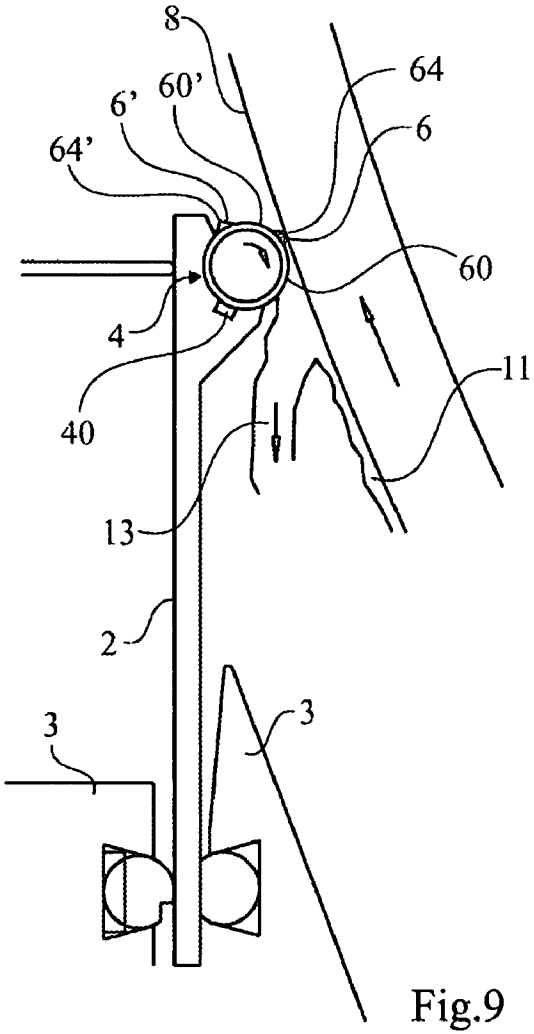

FIGS. 9 and 10 show an alternative embodiment of the invention in which the basic principle is essentially the same as has been described in connection with FIG. 1-3. Accordingly, a spring blade 2 is shown that at its end carries a socket for a dosing member 4 in the same manner as has been described in connection with FIG. 1-3, and therefore only the differences will be explained in the following.

Two bodies 64, 64' of essentially triangular cross section are arranged at the peripheral surface 60 of the dosing member 4. These two bodies 64, 64' are made of exactly the same material, a suitable ceramics e.g., and accordingly their contact surfaces 6, 6' have the same properties. The object of this type of dosing device 4 is to have a spare surface 6' in preparation for a situation in which the first surface 6 has been worn out or damaged. As is clear from FIG. 9, one surface 6 is initially in contact with the web 8 and the other surface 6' is inactive. When the first surface 6 has been worn out or damaged, the shifting member 40 initiates a clockwise turning of the dosing member 4 whereby the second surface 6' finally will end up in an active position instead of the worn out surface 6, in accordance with FIG. 10. In this embodiment, the configurations and positions of the bodies 64, 64' at the peripheral cylindrical surface 60 are such that the second surface 6' can get in contact with the web 8 without the intermediate surface 60' having to take active part in the dosing operation. This works by the rear surface 6' getting in contact with the web before the first surface 6 (or rather its tip) leaves the web 8, without the intermediate surface 60' exerting any real pressure (dosing operation) on the web 8.

Figure 12:
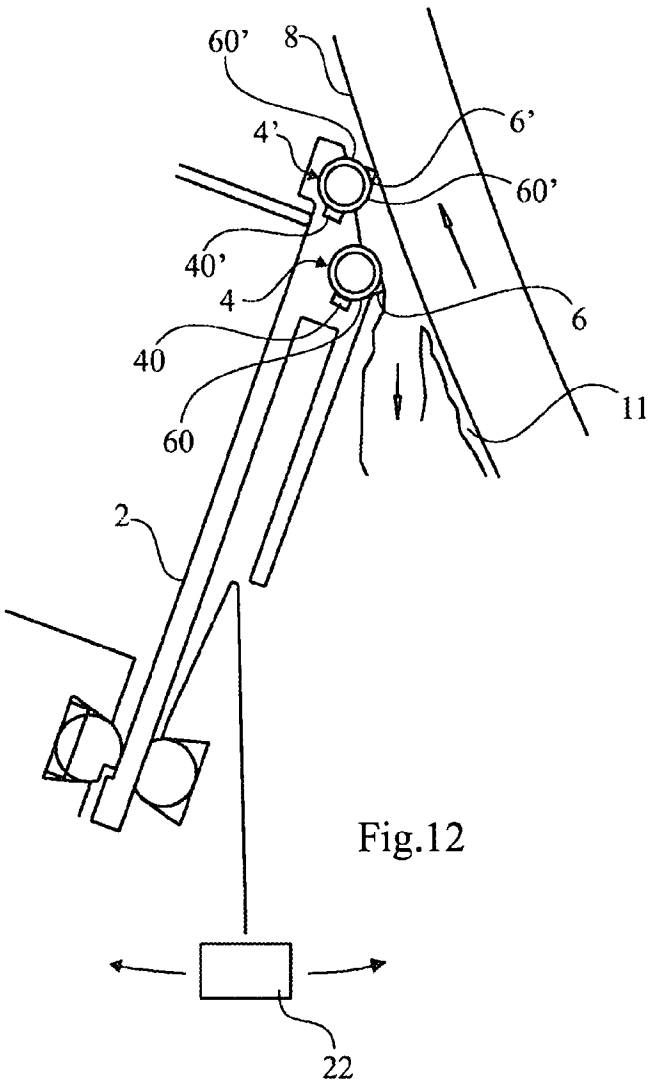
Figure 11:
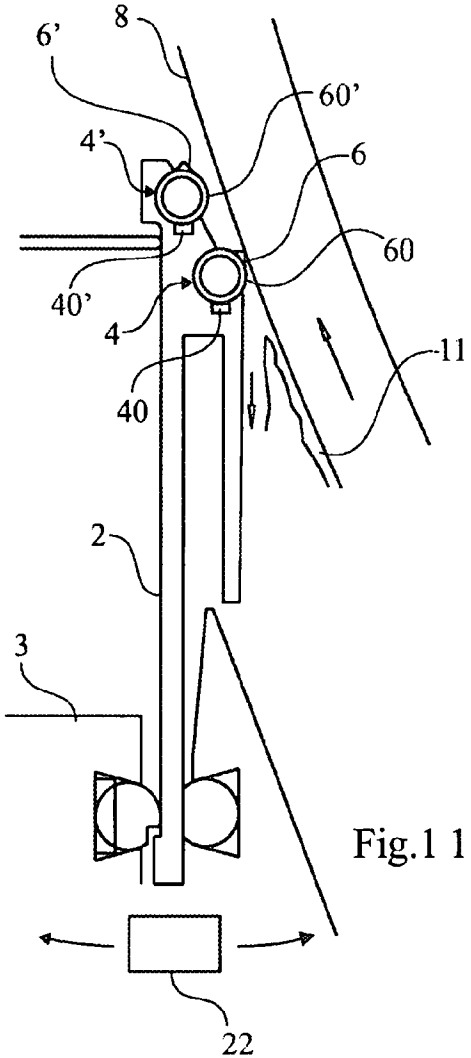

FIGS. 11 and 12 show yet another modification according to the invention, which can be seen as a type of combination of the embodiments shown in FIGS. 1-3 and FIGS. 4-6. The attachment part 2, 3 of the coating means 1 is designed in accordance with the principles shown in FIGS. 4-6, which means that a shifting means 22 can adjust the angle of the blade 2 in relation to the web 8. Each individual dosing member 4, 4' is however designed essentially according to the principles as already described in connection with FIGS. 1-3, i.e. with a cylindrical body that can be turned by a shifting member 40 arranged in a socket at the end of the blade 2. Hence, these details will not be described in more detail.

The major feature of the modification shown in FIGS. 11-12 is that two dosing members 4, 4' are arranged at one and the same blade 2. Accordingly, each dosing member 4, 4' can independently of the other be shifted by its own shifting member 40, 40'. By use of the shifting means 22, thereby to adjust the angle in relation to the web 8, it can accordingly be chosen if the upper 4' or the lower 4 dosing member should be in contact with the web, and by using the additional shifting member 40, 40' it can be chosen if the surface 6, 6' projecting from the body should be in contact with the web or if instead the peripheral cylindrical surface 60, 60' of the respective dosing member should be in contact with the web. By this modification an additional flexibility is achieved in that the different component shifting means/members 22, 40, 40' can be used to position the active surfaces in many varied ways in relation to the running web 8. Of course, this embodiment can be used also with a plurality of projecting surfaces at the dosing member 4, 4' (at one of them or at both of them).

Of course, other fields of application are conceivable within the scope of the invention.

Also when using the embodiment of the invention that is illustrated in FIGS. 7-8 it is possible to exchange the active surface 7 of the outer dosing blade without stopping the coating process, which means that costly production losses can be diminished. Exchanging of dosing blades is brought about by normal wearing or by the passing of foreign hard particles that damage the active surface of the blade.

When using the embodiment illustrated in FIGS. 1-3 the advantage is also achieved that the turning of the dosing element also can be used as a manner of controlling the amount of coating mix that is dosed out. By turning the dosing member to decrease the wedge shaped entrance angle β between the running web 8 and the surface 7 of the dosing means, the amount dosed out will increase. Increasing said angle β will decrease the amount dosed out. It is realised that advantageously this aspect of the invention can be used as such, which is clear from FIG. 3 in which the turnable dosing element 4 controls the amount of coating mix by a single coating surface 7 (independent of if the cylindrical surface 6 is intended for coating or not) and its angle β in relation to the envelope surface of the roller 9. Advantageously this aspect is used in connection with a transfer coater, i.e. in which the coating mix is supplied directly to the envelope surface of a roller (in the absence of an intermediate web 8), such as an engraving roller, an intermediate roller being arranged to transfer it to the web (see FIG. 13). Accordingly we reserve the right of applying for a separate patent protection for this aspect without association to a simultaneous arrangement of two coating surfaces at the dosing member. The shifting member 40 can be of a variety of shapes, anything from manual control to fully automated control whereby it is suitable to use electric control devices and/or pneumatics controlled by suitable sensors/gauges (not shown) via a control unit (not shown).

Figure 13:
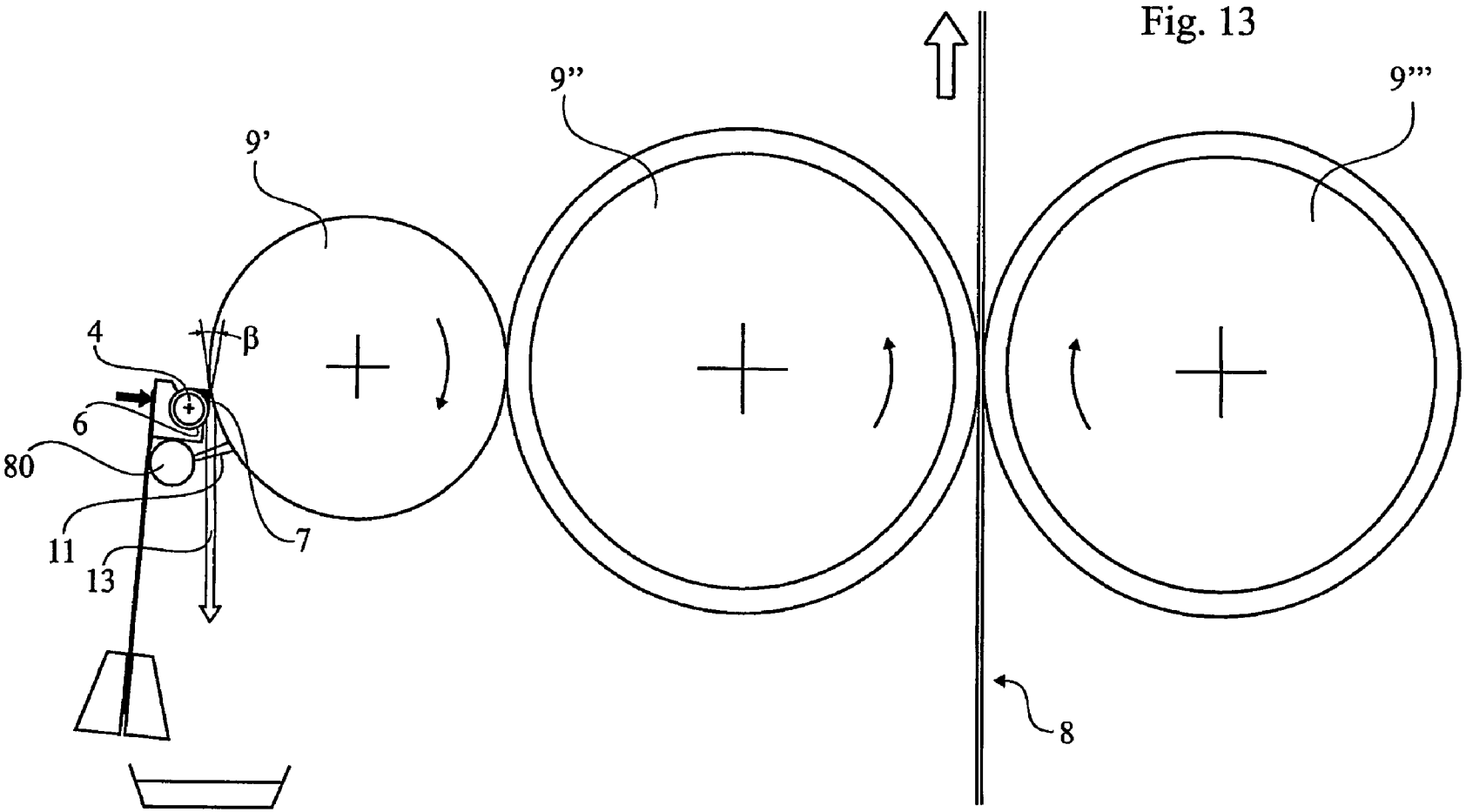
FIG. 13 shows a method according to a particular aspect of the invention, in which a coating member according to the invention is used as a dosing means for a so called transfer coating machine. In this case, the web is running upwards.

FIG. 13 shows that the coating mix 11 is applied at a pattern on a web 8 that is running upwards in the nip between a rubber coated transfer roller 9" and a counter pressing roller 9'''. By a coating member 7 according to the invention, the coating mix 11 is supplied to the transfer roller 9" via an engraving roller 9' the gravure of which has been finally dosed with a coating mix 11, whereby, in accordance with that described above, only the soft blade 7 and its angle β is used for the direct dosing on the envelope surface of the roller 9'. The pre-dosing of the coating mix 11 on the engraving roller 9' can suitably take place in different ways known per se, such as is shown with fountain applicators 80 that are suitably arranged to form a unit at the dosing means 1. It is furthermore shown in FIG. 13 that in this application the extension of the blade is preferably longer such that its base covers more than 45° and more preferred about 90° of the envelope surface of the dosing member 4.

The invention is not limited to that described above but may be varied within the scope of the claims.

For example, it is within the scope of the claims to use all sorts of materials in the active contact surfaces, i.e. the invention is not limited to a soft material in one of the active contact surfaces 6, 7.

It is realised that the active surfaces for example need not necessarily be arranged to be moveable, but the by aid of a shoe press mechanism e.g., it is possible for the web 8 to be moveable such that both, or at least one, of the active surfaces 6, 7 can be stationary arranged while the same function is achieved as when the active surfaces are moved according to that described above. It is furthermore realised that the method and a device according to the invention is not limited to be used in connection with shifting between different operational conditions (start up, stop/stop to continuous operation according to the above) but can be used also with the object of maintaining a continuous operation for a longer time than is possible according to conventional techniques, e.g. by arranging a circular dosing body 4 according to FIGS. 1-3 having a plurality of similar surfaces, e.g. a plurality of soft active surfaces 7, which by a turning movement can move a worn active surface 7 from an active position instead to move in a new, unused active surface 7, e.g. in combination with an arrangement according to FIGS. 6-7 in which the hard surface 6 is separately arranged at another body. It is furthermore realised that many other types of combinations can be used within the scope of the invention, for example by arranging two coating means 1 at one and the same web 8, according to FIG. 1-3.

The invention claimed is:

1. A method of coating a running web comprising:

providing a running web arranged to be coated with a coating mix;

providing a coating device arranged in connection with said web, the coating device having a first coating surface and a second coating surface, one of the first and second coating surfaces having a harder surface than the other coating surface, at least one of the first and second coating surfaces arranged in contact with said running web in such a way that it is possible at the running web to switch between the first and second coating surfaces while at least one of the first and second coating surfaces is in contact with the running web; and coating the running web with a coating mix from at least one of the first and second coating surfaces and switching between the first and second coating surfaces while at least one of the first and second coating surfaces is in contact with the running web.

2. A method according to claim 1, wherein the step of providing a coating device further comprises providing one of the first and second surfaces to be active in a first operational condition while the other of the surfaces is arranged to be active in a second operational condition.

3. A method according to claim 2, wherein said first operational condition initiates and/or terminates a coating operation, and that said second operational condition is continuous for a second coating operation.

4. A method according to claim 3, wherein the active surface arranged for said second coating continuous operation is positioned downstream the position of said other surface as seen in the running direction of the web.

5. A method according to claim 1, wherein said switching is achieved by a turning motion.

6. A method according to claim 5, wherein a defined part of said coating device is turned in order to achieve said switching.

7. A method according to claim 6, wherein temperature control of said coating device is achieved by arranging a flow of a tempered liquid through an inner support body of said defined part.

8. A method according to claim 1, wherein the first coating surface is harder than the second coating surface, and the method further comprising coating the running web with the first coating surface during start up in which dry friction occurs between the first coating surface and the running web and switching to coating the web with the second coating surface after the running web is coated from the first coating surface.

9. A method of coating a running web comprising:

providing a running web;

applying a coating to the running web from a dosing member having at least first and second coating surfaces, the dosing member forming a first angle with the running web when the first coating surface is in contact with the running web and the dosing member forming a second angle with the running web when the second coating surface is in contact with the running web, the first coating surface having a different hardness than the second coating surface, the coating being applied from the coating surface in contact with the running web; and switching between the first coating surface being in contact with the running web to the second coating surface being in contact with the running web by changing the angle of the dosing member with the running web, wherein at least one of the first and second coating surfaces is in contact with the running web during switching of the coating surfaces.

10. A method of coating a running web comprising:

providing a running web;

applying a coating to the running web from a dosing member having a first blade having a first coating surface and a second blade having a second coating surface, the first blade being mounted in a fixed position so that the first contact surface is not in contact with the running web, the second blade being tiltably mounted so that in a first position the second coating surface is not in contact with the running web and in a second position the second coating surface is in contact with the running web, one of the first and second coating surfaces having a higher hardness than the other coating surface, the coating being applied from the coating surface in contact with the running web;

bending the first blade so that the first coating surface is in contact with the running web; and switching between the first coating surface being in contact with the running web to the second coating surface being in contact with the running web by allowing the first blade to unbend and move the first coating surface away from the running web and tilting the second blade from the first position to the second position, wherein at least one of the first and second coating surfaces is in contact with the running web during the switching of the coating surfaces.

* * * * *